United States Patent [19]

Walworth et al.

[11] Patent Number: 4,557,080

[45] Date of Patent: Dec. 10, 1985

[54] AUTOMATIC SEATING FOR TELESCOPING ROW SYSTEMS

[75] Inventors: Robert S. Walworth; Jay Hinshaw, both of Grand Rapids; Arnold H. LaBotz, Grandville, all of Mich.

[73] Assignee: American Seating Company, Grand Rapids, Mich.

[21] Appl. No.: 631,919

[22] Filed: Jul. 18, 1984

[51] Int. Cl.[4] ..... E04H 3/12

[52] U.S. Cl. ..... 52/9; 297/332

[58] Field of Search ..... 52/6, 7, 8, 9, 10; 297/236, 331, 332, 333

[56] References Cited

U.S. PATENT DOCUMENTS

| | | | |
|---|---|---|---|
| 3,352,069 | 11/1967 | Curra, Jr. | 52/9 |
| 3,429,081 | 2/1969 | Robinson et al. | 52/9 |
| 3,443,835 | 5/1969 | Brunskole | 52/9 X |
| 4,000,586 | 1/1977 | Vance et al. | 52/9 |
| 4,063,392 | 12/1977 | Van Ryn et al. | 52/9 |
| 4,155,202 | 5/1979 | Hartman | 52/9 |
| 4,189,876 | 2/1980 | Crossman et al. | 52/9 |
| 4,211,450 | 7/1980 | Sutter | 297/232 |
| 4,294,048 | 10/1981 | Sutter | 52/9 |
| 4,446,659 | 5/1984 | Quigley | 52/9 |

FOREIGN PATENT DOCUMENTS

| | | | |
|---|---|---|---|
| 2735911 | 2/1979 | Fed. Rep. of Germany | 52/9 |
| 1420615 | 1/1976 | United Kingdom | 52/9 |

*Primary Examiner*—Donald G. Kelly
*Assistant Examiner*—Richard E. Chilcot, Jr.
*Attorney, Agent, or Firm*—Emrich & Dithmar

[57] ABSTRACT

Improved automatic seating for a telescopic system includes stancheons for mounting individual chairs. Each stancheon includes forward and rear frame members which are pivotally mounted to a bracket and arranged to pivot between a raised use position when the rows are extended and a lowered storage position when the rows are retracted for storage. A coil spring is connected between the stancheon frame members and biases them to the raised position so that the seating raises automatically when the rows are extended for use. Each stancheon is secured in the raised position by a self-tightening latching mechanism which is actuated independently of all other stancheon latches so as to compensate for tolerances in an individual stancheon assembly and to latch it securely in the use position, whereas all latches are disengaged in unison by movement of the next lower row to its storage position. The stancheon frame members cooperate not only to tension the coil spring as they are rotated to the storage position to provide a restoring force for raising the seating, but they also rotate the arm rest to become generally aligned with the stancheons as the seating is lowered to the storage position.

13 Claims, 3 Drawing Figures

FIG. 2
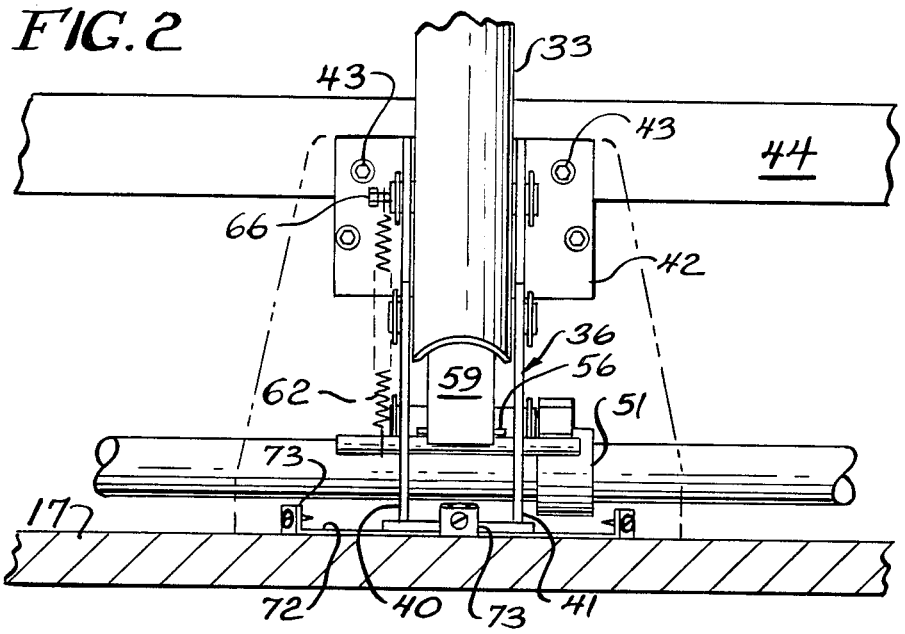
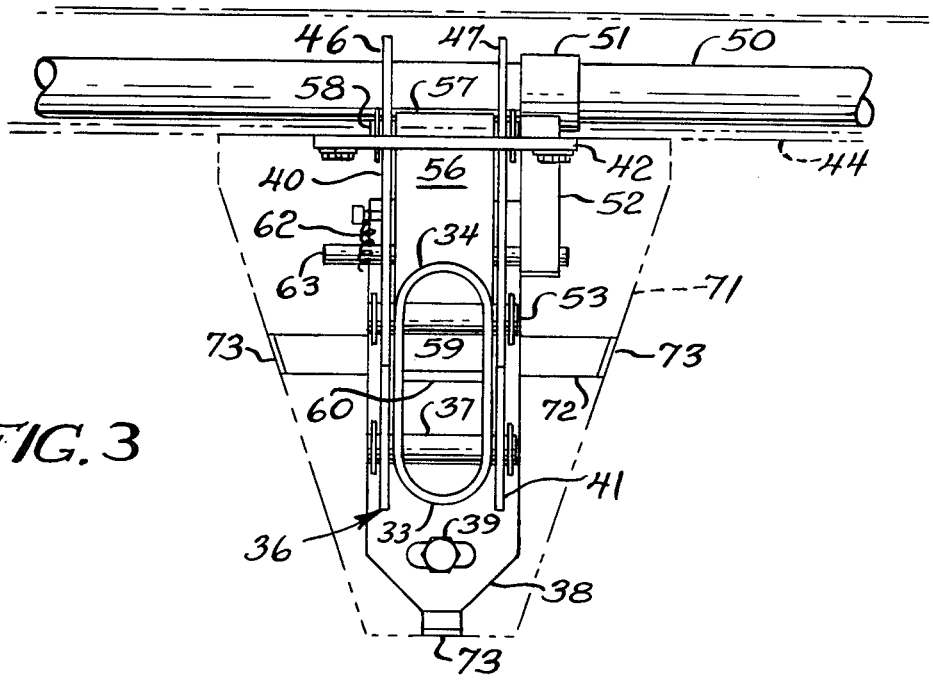
FIG. 3

AUTOMATIC SEATING FOR TELESCOPING ROW SYSTEMS

FIELD OF THE INVENTION

The present invention relates to telescoping seating systems; and more particularly, it relates to improvements in telescoping seating systems wherein the seating is automatically raised to the use position when the rows are extended in tiered or stepped relation to one another, and automatically lowered for storage when the rows are retracted or nested, each lower row being received within the next higher row so that all of the rows are generally vertically aligned in the storage position.

BACKGROUND OF THE INVENTION

Telescoping seating systems are well-known in the art, and they generally include a plurality of rows, each row having wheeled carriages for movement along the floor of a gymnasium, or auditorium, a frame or understructure including columns or posts extending upwardly from the carriages to the height of a given row, and a riser beam mounted horizontally to the tops of the columns. A deck, including a foot rest platform and seating is cantilevered from the riser beam and columns by means of arms secured to the riser beam.

One of the primary problems facing engineers designing telescoping seating systems is to provide seating which is comfortable and secure in the use position, yet which conveniently folds and is stored in the space between adjacent rows in the storage position. If the seating is simply wooden benches, then the height of the bench can be less than the vertical space between decks when adjacent rows are nested for storage, and the problem is obviated. However, bleacher-type seating is generally considered to be less comfortable to an occupant than individual chairs. Individual chairs, however, provided with a seat and back as well as arm rests obviously cannot fit in the space between adjacent decks for storage, since that space typically is in the range of 10–12 inches.

Thus, individual chair seating is preferred over bleacher seating in terms of convenience and comfort. However, if the seating requires manual labor to raise and lower the chairs, it can be a significant disadvantage because, depending upon the size of the arena, it can require a substantial number of workers who are not ordinarily employed on a continual basis just for this task.

Therefore, attempts have been made to provide individual chair seating which is raised and lowered automatically with the extension and retraction of the rows. One such system is disclosed in the Van Ryn U.S. Pat. No. 4,063,392. In this system, the seats of the chairs are permanently mounted to the forward portion of a deck and only the back of an individual chair is raised or lowered. The back is locked in the raised position and it is released in response to the actuation of a single tube mounted beneath the deck and extending along the width of the deck beneath the seating. Separate latching mechanisms are provided for each chair back, and all the latches are released in unison by the actuator tube. The backs are raised to the use position by means of a spring.

Another automatic chair platform system is disclosed in the Hartman U.S. Pat. No. 4,155,202. This system provides for the convenience and comfort of individual chair seating wherein the height of the seat is independent of the rise of the system. A number of chairs are grouped together, and each gang of chairs is locked in place by at least two latching members which are engaged by the nose portion of the next higher row in order to unlock the seating. This system had the disadvantage that it is susceptible to problems when rows become out of parallel.

That is, during the retraction of a row, if one side of the row wheel carriage engages an obstruction, the row being retracted may become slightly out of parallel, thereby rendering it uncertain as to whether both latches would be disengaged prior to having a portion of the seating engage the nose of the next higher row. In this system, torsion rods are connected between the seating and the deck for supplying a counter-balancing force to the seating when it is lowered, to at least partially offset the weight of the seating when it is raised to the use position. In order to raise the seating, members were hinged to a higher row to engage the seating on the next lower row so that when the lower row is extended, the hinge members engage the seating and assist the torsion springs in elevating it.

Another automatic seating system, and one which was made commercially available, is disclosed in U.S. Pat. No. 4,446,659. This system has a single drive rod for locking and unlocking individual chairs, but due to manufacturing tolerances in a structure of this type, once the drive rod locked any one of the chairs in a row, it becomes fixed and can not tighten the latches of adjacent chairs so that some of the chairs are permitted a slight movement which, though not unsafe, may give a feeling of looseness to an occupant. Further, when it is desired to provide arm rests on a chair, the length of the arm rests are limited by the available space for storage because the arm rests are fixed to the chair frame.

SUMMARY OF THE INVENTION

According to the present invention, individual chairs each are provided with a seat, a back and arm rests, as well as side stancheons for supporting them. Adjacent chairs may be mounted to a single stancheon.

Each stancheon includes a forward and a rear frame member, each pivotally mounted to a bracket attached to the rear of the tread of a row. The frame members of a stancheon are preferably provided in the form of channel members having a U- or a C-shape with the open portions of the channels in opposing, facing relation.

A coil spring is connected under tension between the stancheon frame members and housed within the channel shape of the frame members for biasing the stancheons to the raised position so that the seating is elevated automatically when the rows are extended. By using two frame members and mounting their bases sufficiently far apart, sufficient extension of a coil spring is obtained to exert a restoring force on the seating to elevate the seating without the need for a mechanical assist of the type heretofore used in the aforementioned seating systems disclosed in the '202 and '659 patents described above.

Each stancheon is secured in the raised position by a self-tightening latching mechanism which is spring-actuated independently of all other latches in a given row so as to compensate for tolerances in an individual stancheon assembly and securely to latch it in the elevated position. The latches are all released together by a common rod mounted above the deck within the riser beam of the row and actuated by the movement of the next lower row to the retracted or nested storage position.

The frame members of each stancheon cooperate not only to increase the tension of the spring as the stancheons are rotated to the storage position to generate the additional force for raising the seating, but the stancheons, due to their structure, act as a four-bar linkage to rotate the arm rests which are pivotally mounted to the frame members so that the arm rests are aligned with the stancheons for storage.

In summary, the improvements of the present invention more readily accomodate automatic seating structure to the realistic manufacturing practices of telescopic seating systems, maintaining the advantages of automatic seating, but accommodating the structure to tolerances obtainable in production quantities without elaborate adjusting mechanisms in the field.

Other features and advantages of the present invention will be apparent to persons skilled in the art from the following detailed description of a preferred embodiment accompanied by the attached drawing wherein identical reference numerals will refer to like parts in the various views.

BRIEF DESCRIPTION OF THE DRAWING

FIGS. 2 and 3 are fragmentary front and plan close-up views respectively of the mounting structure for the seating shown in FIG. 1.

DETAILED DESCRIPTION OF THE ILLUSTRATED EMBODIMENTS

Figure 1:
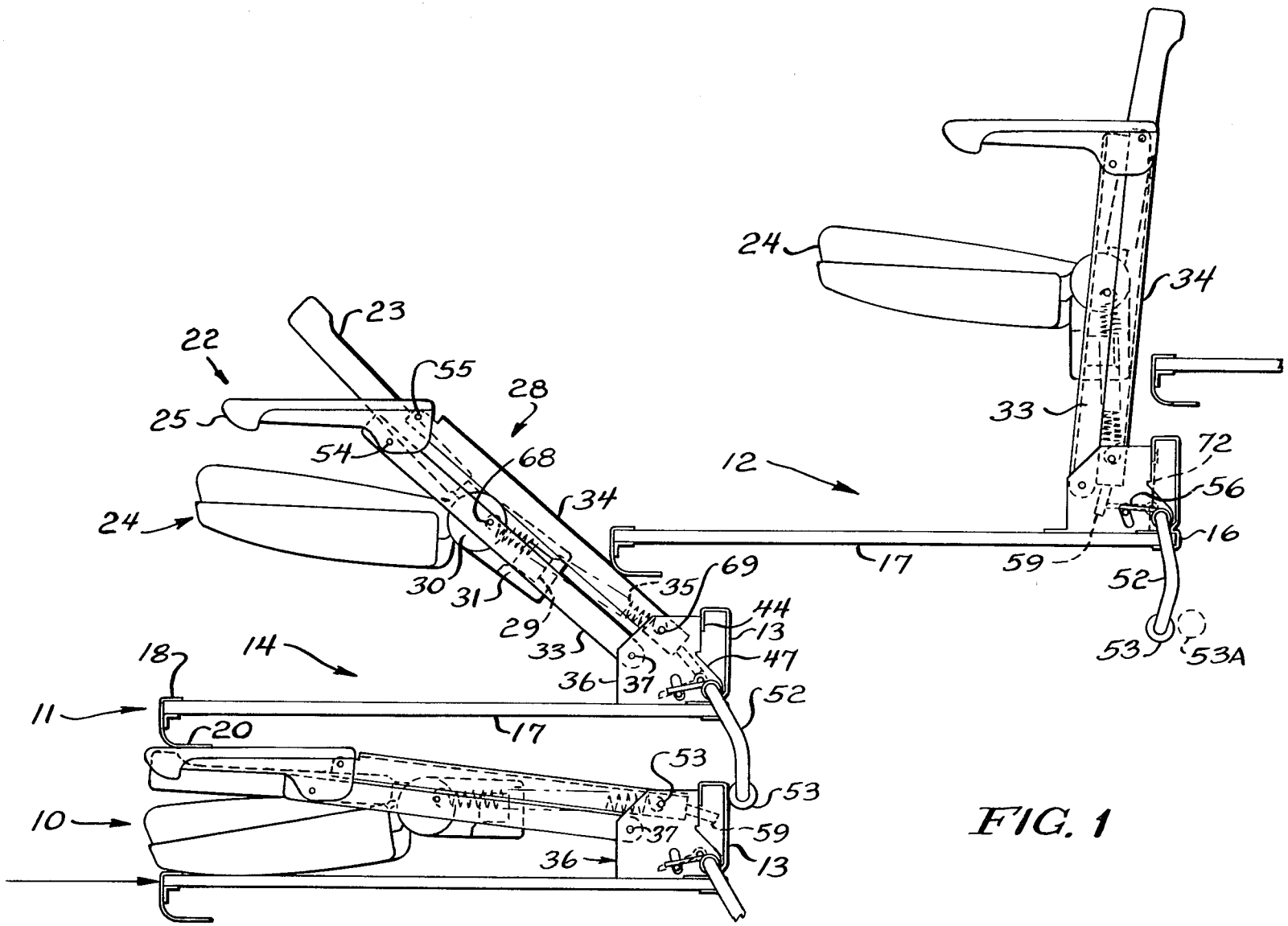
FIG. 1 is a fragmentary side view illustrating portions of three adjacent rows, each equipped with automatic seating constructed according to the present invention.

As used herein, "left" and "right" refer respectively to the left and right sides of the system from the viewpoint of an observer standing in front of and facing the seating system (i.e., to the left in FIG. 1). Referring, then, to FIG. 1, portions of three separate rows of a telescoping seating system are shown from the right side and designated respectively 10, 11 and 11. When the system is extended to the use position, the rows are in stepped or tiered relation. The seating of row 12 is arranged for use. On the other hand, when the system is retracted for storage, the seating is located in the vertical space between adjacent rows, as shown in FIG. 1 for row 10. In the storage position, the rows are nested within one another so that the decks are generally vertically aligned, as can be see by comparing rows 11 and 12.

Each row includes a frame or understructure, including wheel carriages and vertical posts for carrying a deck and associated seating. However, the understructure forms no part of the present invention and is not shown in detail. A preferred understructure is shown in the Pari U.S. Pat. No. 4,041,655. As used herein, the term "row" includes the movable understructure, the deck portion cantilevered from the understructure and the seating associated with that particular deck.

As mentioned previously, each deck includes a riser beam such as the one designated 13 for the row 11 which is connected between the upper portions of the columns or posts for that row. The riser beam forms a part of a deck generally designated 14, and toward that end, the lower portion of the riser beam is formed into a channel (as seen at 16 for row 12) to receive and support continuously the rear edge of a footrest platform 17. The forward edge of the platform 17 is similarly received in a suitable channel of a nose beam 18, the lower portion of which is formed into a curved bumper 20 for forcing the seats to the lowered or storage position after the seating has been unlatched, as will be seen.

Each row also contains a plurality of individual chairs such as the one generally designated 22. Each chair includes a back 23, a seat generally designated 24 and a pair of arm rests, one of which is seen at 25 for the chair 22. The chairs are supported at each side by a stancheon assembly generally designated 28. One stancheon assembly may provide support for two adjacent chairs.

Any suitable structure for mounting the seat backs and seats to the stancheon assemblies may be employed and forms no part of this invention. In the illustrated embodiment, a cross beam having a generally rectangular cross section and shown in phantom at 29 may be connected between adjacent stancheon assemblies; and a conventional seat hinge and back support assembly 30 is mounted to the beam 29 by means of a bracket 31. The hinge assembly 30 may be of the type known in the art which biases the seat 24 to a three-quarters fold position when the chair is elevated, although the seat for the deck 12 is shown lowered to the use position for illustration purposes. The hinge assembly also permits the seat to be fully elevated to a generally vertical position relative to the back 23 both for permitting the occupant to stand and allow passage in an aisle and for storage, as seen for the lowermost row 10 of FIG. 1.

Turning now to the stancheon assembly 28, it includes a forward frame member 33 and a rear frame member 34, preferably in the form of open channels having a U- or C-shaped section, as seen in FIG. 3, and arranged in facing or opposing relation such that the openings of the channels face one another. In this manner, the frame members 33, 34 cooperate to provide a housing for a coil spring shown in dashed line schematically in FIG. 1 and designated 35. The spring 35 is connected under tension between frame members 33, 34. The curvature of the back of the rear frame member 34 reduces friction with the bumper 20 of the next higher row as the seating is lowered.

Referring to FIGS. 1 and 3, the lower portion of forward frame member 33 is pivotally connected to a mounting bracket 36 by means of a pin 37. As best seen in FIGS. 2 and 3, the mounting bracket 36 includes a base plate 38 secured to the platform 17 by means of a bolt 39. Bracket 36 also includes a pair of upright, spaced side plates 40, 41 which are welded to the base plate 38 and are spaced to receive the frame members 33, 34 while permitting them to rotate. The bracket 36 also includes a vertical mounting plate 42, best seen in FIG. 2, which is secured by bolts 43 to the forward, vertical flange 44 of the riser beam 13.

As best seen in FIGS. 1 and 3, the side plates 40, 41 of the bracket 36 extend rearwardly at their lower sections into the space defined by the rear riser beam 13 to form respectively extensions 46 and 47. An actuator rod 50 is journalled in the extensions 46, 47 for rotation about a horizontal axis. The rod 50 may extend the full width of the row. An actuator arm 52 is attached to each end of rod 50. The lower portion of arm 52 is provided with a roller 53 adapted to be engaged by the rear surface of the riser beam 13 of the next lower row. The actuated or unlocked position of the actuator arm 52 for the row 12 is seen dashed at 53A in FIG. 1. When viewed from the right, the actuator arm 52 is rotated counterclockwise from the position as seen for row 12 to the position seen for row 11 in FIG. 1 to unlock the seating associated with row 11, as will be described presently, when the next low row is retracted or nested beneath the row associated with that actuator arm.

A collar 51 is secured to the actuator arm 50 adjacent the mounting bracket 36, and a forwardly-extending tab in the form of a flat piece of metal designated 52 is welded to the collar 51. The purpose of the tab 52 is to unlock the stancheon with which it is associated, as will be described presently.

As seen in FIG. 3, the pin 37 which pivotally mounts the forward frame member 33 to the bracket 36 is journalled in the side plates 40, 41 and held by retainer washers. The rear frame member 34 is similarly pivotally mounted to the bracket 36 by means of a pin 53 journalled in the side plates 40, 41.

The arm rest 25 is pivotally connected to the forward frame member 33 at 54 and to the rear frame member 34 at 55, as seen in FIG. 1. There is thus formed a four-bar linkage (which in the illustrated embodiment is actually a parallelogram) including the forward frame member 33, the rear frame member 34, the portion of mounting bracket 36 between the pivot connections 37 and 53, and the portion of the arm rest 25 between the pivot connections 54, 55. The function of this four-bar linkage is to rotate the arm rest 25 from the generally horizontal use position seen for row 12 in which the arm rest is almost perpendicular to the stancheon assembly, to the storage position seen for row 10 in which the arm rest is still generally horizontal but now aligned with the direction of elongation of the stancheon assembly.

Referring now to FIGS. 2 and 3, a latch member or tongue 56 in the form of a flat is welded to a collar 57 which is journalled on a pin 58. The pin 58 is, in turn, journalled in the brackets 46, 47 and held by means of retainer clips similar to the manner in which the pins 53 and 37 are mounted. An extension bar 59 (see row 10 in FIG. 1) is welded within and extends below rear frame member 34.

In the raised position, the opposing edges of the forward and rear frame members 33, 34 engage to limit the clockwise rotation of the stancheon assembly in the use position, as seen for row 12 in FIG. 1. When the stancheon assembly is raised to the use position, a spring 62 raises a cross pin 63 which extends through slots in the side plates 40, 41 (see the slot 64 for the side plate 41 for row 12 in FIG. 1) to elevate the tongue 56 of the latch member to the locking position, see FIG. 2. The upper end of the spring 62 is fastened to a fixed pin 66 carried by the side plate 40, as best seen in FIG. 2. It will be appreciated that as a person occupies one of the chairs, any shifting of the weight toward the rear will cause the extension 59 to rotate further clockwise so that the spring 62 will tighten the action of the latch member 56. This self-tightening action is independent of all other chairs in the row, and is desirable because of the stability and rigidity it gives to the seating. This is referred to as the self-tightening feature of the latch; and it is considered an important improvement over the prior art.

The previously described unlatching actuator or flat 52 is located above the right side of the pin 63 (which extends fully through the mounting bracket). Thus, when the next lower row is retracted, the actuator arm 52 is rotated counterclockwise, as is the rod 50, thereby causing the flat or tab 52 to depress the cross pin 63 against the action of spring 62. This releases the latch 56 because the pin 63 is welded to the bottom of the tongue 56.

When a stancheon assembly is unlatched as described above, the seating is free to be urged to the storage position as seen for row 10 by the bumper 20 of the nose beam of the next higher row, as illustrated in process for row 11 in FIG. 1. The curvature of bumper 20 cooperates with the curved rear surface of the rear frame member 34 (see FIG. 3) to reduce friction and to ease the folding of the chairs to the storage position. Conversely, when a lower row is extended for use, the coil spring 35, the ends of which are secured at 68 to the upper part of forward frame member 33 and at 69 to the lower part of rear frame member 34, provides a restoring force to elevate the chairs to the raised position as seen for row 12.

It will thus be appreciated that all of the stancheon assemblies for a given row are unlocked by a common actuator mechanism-namely, the arms 52 which rotate with the rod 50 to depress the cross pin 63. However, each individual stancheon assembly is latched by an independent, spring-actuated mechanism-namely, the action of spring 62 elevates the tongue 56 which is independently mounted to pin 58 by means of collar 57. Thus, each latching assembly is self-tightening due to the action of the spring, and is free to accomodate itself to the particular tolerances of that stancheon. All stancheons are unlocked when the actuator arm 52 at either end of the row is actuated and prior to the complete retraction of the next lower row, permitting the seating to be pushed to the storage position.

It will also be appreciated that the forward and rear frame members 33, 34 of a stancheon cooperate to house the spring 35, and that by virtue of the four-bar linkage mechanism described, sufficient extension of the spring 35 can be obtained to obviate the need for further assistance in mechanically raising the seating to the storage position. Still further, it is considered advantageous that the spring 35 has its axis in a straight line throughout all positions of use and storage. This maintains the spring in the linear part of its deflection characteristic and obviates any tendency to buckle.

The bracket and mounting assembly is preferrably hidden from view by means of a plastic canopy or shroud shown in chain line in FIG. 3 and designated 71. The shroud is provided with a suitable opening to accomodate the movement of the stancheon assembly between the two positions, and its lower edge is fastened to upturned flanges 68 of a plate 69 by means of sheet metal screws. As illustrated in FIG. 1, the rod 50, since it is received in the space defined by the rear riser beam 13, can be completely hidden from view by mounting cover plates 72 to the rear of the vertical upper flange 44 of the riser beam 13 (see row 12). In this manner, the bracket 36 and all latching and unlatching mechanism as well as the actuator rod 50 are hidden from view, and the appearance of the system is improved in that a cleaner appearance with less mechanism is provided and maintenance is also reduced in that the surfaces are flush and there are no crevises for dirt or debris collection.

Having thus disclosed in detail a preferred embodiment of the invention, persons skilled in the art will be able to modify certain of the structure which has been disclosed and to substitute equivalent elements for those illustrated while continuing to practice the principle of the invention; and it is, therefore, intended that all such modifications and substitutions be covered as they are embraced within the spirit and scope of the appended claims.

We claim:

1. In a telescoping seating system having a plurlity of rows adapted for movement between a use position in which said rows are in tiered relation and a storage position in which a lower row is at least partially nested beneath a higher row, each row including a deck and seating means, the improvement comprising: stancheon means for supporting said seating means and including first and second frame members each pivotally mounted to said row at spaced locations and adapted to be rotated in unison between a generally upright use position and a generally horizontal storage position; and spring means connected between said frame members for biasing them to the use position, said frame members and spring being constructed and arranged such that the force of said spring biasing said frame members to the use position is decreased as said frame members are moved to the use position.

2. The apparatus of claim 1 wherein said frame members cooperate to engage one another in the use position to define the position of said seating means in the use position.

3. The apparatus of claim 1 wherein said spring means includes a coil spring and said frame members cooperate to enclose said coil spring in the use position.

4. The apparatus of claim 1 further comprising a bracket mounted to said deck adjacent the rear riser thereof; and first and second means for pivotally mounting said first and second frame members adjacent the respective bottoms thereof for rotation about first and second horizontal axes spaced from each other vertically and in a fore-and-aft direction; said second frame members being generally aligned with and to the rear of said first frame member in the use position.

5. The apparatus of claim 4 including a plurality of said stancheon means for supporting said seating means, and further comprising a latch mechanism for each stancheon and characterized in being self-tightening when actuated and independently of other latch mechanisms in the latching position.

6. The apparatus of claim 5 wherein said frame members are generally channel-shaped having elongated openings arranged in opposing relation and cooperating to house said coil spring.

7. The apparatus of claim 6 wherein said spring is under tension in the use position and is elongated in the storage position by relative movement between the locations at which said ends of said spring are connected to said frame members as said frame members are rotated to the use position, and characterized in that said springs provide the sole force for raising said stancheons and seating to the use position.

8. The apparatus of claim 7 wherein the rear surface of said second frame member is smoothly curved in a forward direction and is engaged by a forward portion of the next higher row during retraction of the lower row to urge said seating to the storage position, said engaging portion of said next higher row being curved downwardly and rearwardly.

9. The apparatus of claim 4 further comprising an arm rest for each stancheon and first and second means for pivotally mounting said arm rest to said first and second frame members respectively, such that said arm rest is rigidly secured in the use position when said stancheons are elevated and said arm rest is rotated to be generally aligned with its associated stancheon when said stancheon is lowered for storage.

10. The apparatus of claim 5 wherein each latch mechanism includes a spring for biasing said latch mechanism to the latching position, and further comprising: actuator means for each row responsive to retraction of the next lower row to the storage position for disengaging all of said latch mechanisms together while permitting said spring of each latch mechanism independently to bias said latch mechanism to the latching position.

11. In a telescoping seating system having a plurlity of rows adapted for movement between a use position in which said rows are in tiered relation and a storage position in which a lower row is at least partially nested beneath a higher row, each row including a deck and seating means, the improvement comprising:

a plurality of stancheon means for supporting said seating means;

each stancheon including first and second frame members, first and second mounting means for pivotally mounting each of said first and second frame members respectively to said row at spaced locations whereby said frame members are adapted to be rotated in unison between a generally upright use position and a generally horizontal storage position;

spring means connected between said first and second frame members for biasing them to the use position, said frame members and spring being constructed and arranged such that the force of said spring biasing said frame members to the use position is decreased as said frame members are moved to the use position;

a latch mounted for independent pivotal motion to engage one of said frame members for locking said stancheon in the use position and including second biasing means for tightening said latch as permitted by motion of said stancheon; and means associated with a plurality of adjacent stancheon means and responsive to retraction of a lower row for unlatching a plurality of said latches in unison.

12. The apparatus of claim 11 wherein said first and second frame members are channel-shaped and mounted in opposing relation for housing said first spring means and cooperating to engage and limit the motion of said seating in the raised position.

13. The apparatus of claim 12 wherein each stancheon further comprises an arm rest pivotally mounted to both of said frame members and rotated to a position of alignment with the direction of elongation of said stancheon members in the storage position.

* * * * *